US006485128B1

(12) United States Patent
Elshaik et al.

(10) Patent No.: US 6,485,128 B1
(45) Date of Patent: Nov. 26, 2002

(54) INK JET PEN WITH A HEATER ELEMENT HAVING A CONTOURED SURFACE

(75) Inventors: Nagwa M. Elshaik, Corvallis, OR (US); Ulrich Hess, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 1065 days.

(21) Appl. No.: 08/946,523

(22) Filed: Oct. 7, 1997

Related U.S. Application Data

(63) Continuation of application No. 08/606,459, filed on Mar. 4, 1996, now abandoned.

(51) Int. Cl.[7] ..... B41J 2/01; B41J 2/05

(52) U.S. Cl. ..... 347/62

(58) Field of Search ..... 347/62, 61, 64, 347/63, 65

(56) References Cited

U.S. PATENT DOCUMENTS

| | | | | |
|---|---|---|---|---|
| 4,336,548 A | | 6/1982 | Matsumoto | 347/64 |
| 4,339,762 A | | 7/1982 | Shirato et al. | 347/62 |
| 4,490,728 A | * | 12/1984 | Vaught | 347/63 X |
| 4,513,298 A | | 4/1985 | Scheu | 347/64 |
| 4,514,741 A | | 4/1985 | Meyer | 347/62 |
| 4,792,818 A | * | 12/1988 | Eldridge | 346/62 X |
| 4,794,411 A | | 12/1988 | Taub et al. | 347/56 X |
| 4,870,433 A | | 9/1989 | Campbell et al. | 347/62 |
| 4,894,664 A | * | 1/1990 | Pan | 347/63 |
| 4,914,562 A | * | 4/1990 | Abe | 347/62 X |
| 4,935,752 A | | 6/1990 | Hawkins | 347/62 |
| 5,041,844 A | | 8/1991 | Deshpande | 347/65 |
| 5,142,308 A | | 8/1992 | Hasegawa et al. | 347/62 |
| 5,169,806 A | | 12/1992 | Hawkins et al. | 437/233 |
| 5,206,659 A | | 4/1993 | Sakurai et al. | 347/62 |
| 5,293,182 A | | 3/1994 | Sekiya et al. | 347/62 |
| 5,400,061 A | | 3/1995 | Horio et al. | 347/55 |

FOREIGN PATENT DOCUMENTS

| | | | | |
|---|---|---|---|---|
| EP | 0124312 A | | 4/1984 | B41J/3/04 |
| EP | 0638424 A2 | | 7/1994 | B41J/2/16 |
| JP | 6334144 A | | 2/1988 | B41J/3/04 |
| JP | 2103150 A | | 4/1990 | B41J/2/05 |
| JP | 403213355 | * | 9/1991 | B41J/2/205 |
| JP | 920338609 | | 12/1992 | B41J/2/05 |

OTHER PUBLICATIONS

"Bubble Generation Mechanism In The Bubble Jet Recording Process"'; By A. Asai, S. Hirasawa, and I. Endo; Journal of Imaging Technology; vol. 14, No. 5, Oct. 1988; pp 120–128.

"Application Of The Nucleation Theory To The Design Of Bubble Jet Printers"; By Akira Asai; Japanese Journal Of Applied Physics, vol. 28, No. 5, May 1989; pp 909–915.

"Thermodynamics And Hydrodynamics Of Thermal Ink Jets"; By Ross R. Allen, John D. Meyer, and William R. Knight; May 1985 Hewlett–Packard Journal; pp. 21–27.

(List continued on next page.)

*Primary Examiner*—John Barlow

(57) ABSTRACT

A thermal ink jet with a body having an ink firing chamber and an orifice. An electrically activated heating element is connected to the body in thermal communication with the firing chamber, and includes a contoured surface portion coextensive with at least a portion of the heating element. The contoured surface portion of the firing chamber has a plurality of recesses.

20 Claims, 6 Drawing Sheets

OTHER PUBLICATIONS

"Microscopic Bubble Formation And Collapse At Liquid–Solid Interfaces During Electrical Powering Of Thin Film Structures"; By S. Matts Goho and T.E. Orlowski; Paper presented at the 15th International Conference on Metallurgical Coatings, San Diego CA USA; Apr. 11–15, 1988; Thin Solid Films, 166 (1988); pp. 335–344.

"15.1 Thermal Analysis Of Thermal Ink–Jet Heater Structure"; By Muralidhar Tirumala, Francis C. Lee; IBM Almaden Research Center, San Jose, CA; SID 1988 DIGEST; pp. 268–270.

"7.4 Materials and Processing Studies For Thermal Ink–Jet Devices" By graham Olive, Jerome M. Eldridge, and James O. Moore; IBM Almaden Research Center, San Jose, CA; SID 1986 DIGEST ; pp 105–107.

"Transformations In Metals"; By Paul G. Shewmon, Professor of Metallurgy at Carnegie–Mellon University; McGraw–Hill Book Company; Copyright 1969; pp. 154–163.

* cited by examiner

INK JET PEN WITH A HEATER ELEMENT HAVING A CONTOURED SURFACE

CROSS REFERENCE TO RELATED APPLICATION

This is a continuation of copending application Ser. No. 08/606,459 filed on Mar. 4, 1996, now abandoned.

FIELD OF THE INVENTION

This invention relates to thermal ink jet printing, and more particularly to heater elements for thermal ink jet printheads.

BACKGROUND AND SUMMARY OF THE INVENTION

Ink jet printing mechanisms use pens that shoot droplets of colorant onto a printable surface to generate an image. Such mechanisms may be used in a wide variety of applications, including computer printers, plotters, copiers, and facsimile machines. For convenience, the concepts of the invention are discussed in the context of a printer. An ink jet printer typically includes a printhead having a multitude of independently addressable firing units. Each firing unit includes an ink chamber connected to a common ink source, and an ink outlet nozzle or orifice. A transducer within the chamber provides the impetus for expelling ink droplets through the nozzles.

In thermal ink jet pens, the transducer is a resistive heater element that provides sufficient heat to rapidly vaporize a small portion of ink within the chamber, forming a bubble. The bubble displaces a droplet of liquid ink from the nozzle. For uniform and precise printer output, it is desirable that the timing, magnitude, rate, shape, and position of the bubble formation be as uniform as possible. Uniformity is desired from firing unit to firing unit, and between sequential droplets originating from the same nozzle.

A particular uniformity concern relates to the boiling properties of fluids. Heterogeneous nucleate boiling, or bubble nucleation, normally occurs at defect sites on the surface of a heating element, or other heated surface. These defects may be cracks, discontinuities, and edges and vertexes where surfaces meet at angle. Heterogeneous nucleate boiling occurs more readily than homogenous or film boiling, which occurs after additional heat energy is added when sufficiently sized nucleation sites are not present. Therefore, it is the heterogeneous nucleation that has the greatest effect during the rapid and uniformity-sensitive boiling process that occurs during thermal ink jet printing.

Existing thermal ink jet printheads have at least partially controlled the heterogeneous nucleate boiling process by providing each firing chamber with a heating element shaped with a single small recessed basin having sharp edges that provide nucleation sites. The basin is smaller than the respective orifice, and registered therewith so that all potential nucleation sites are directly below an open portion of the orifice. This avoids the risk that some firing chambers may lack any nucleation sites and require a higher energy to achieve homogeneous nucleation. The deliberate positioning of the sites in registration with the orifices also reduces the chance that an unintended defect offset from the centerline will generate off axis droplet ejection. However, these improved systems have not achieved ideal uniformity of performance.

The uniformity disadvantages of prior art systems are reduced or overcome by providing a thermal ink jet with a body having an ink firing chamber and an orifice. An electrically activated heating element is connected to the body in thermal communication with the firing chamber, and includes a contoured surface portion coextensive with at least a portion of the heating element. The contoured surface portion of the firing chamber has a plurality of recesses.

DETAILED DESCRIPTION OF A PREFERRED EMBODIMENT

Figure 1:
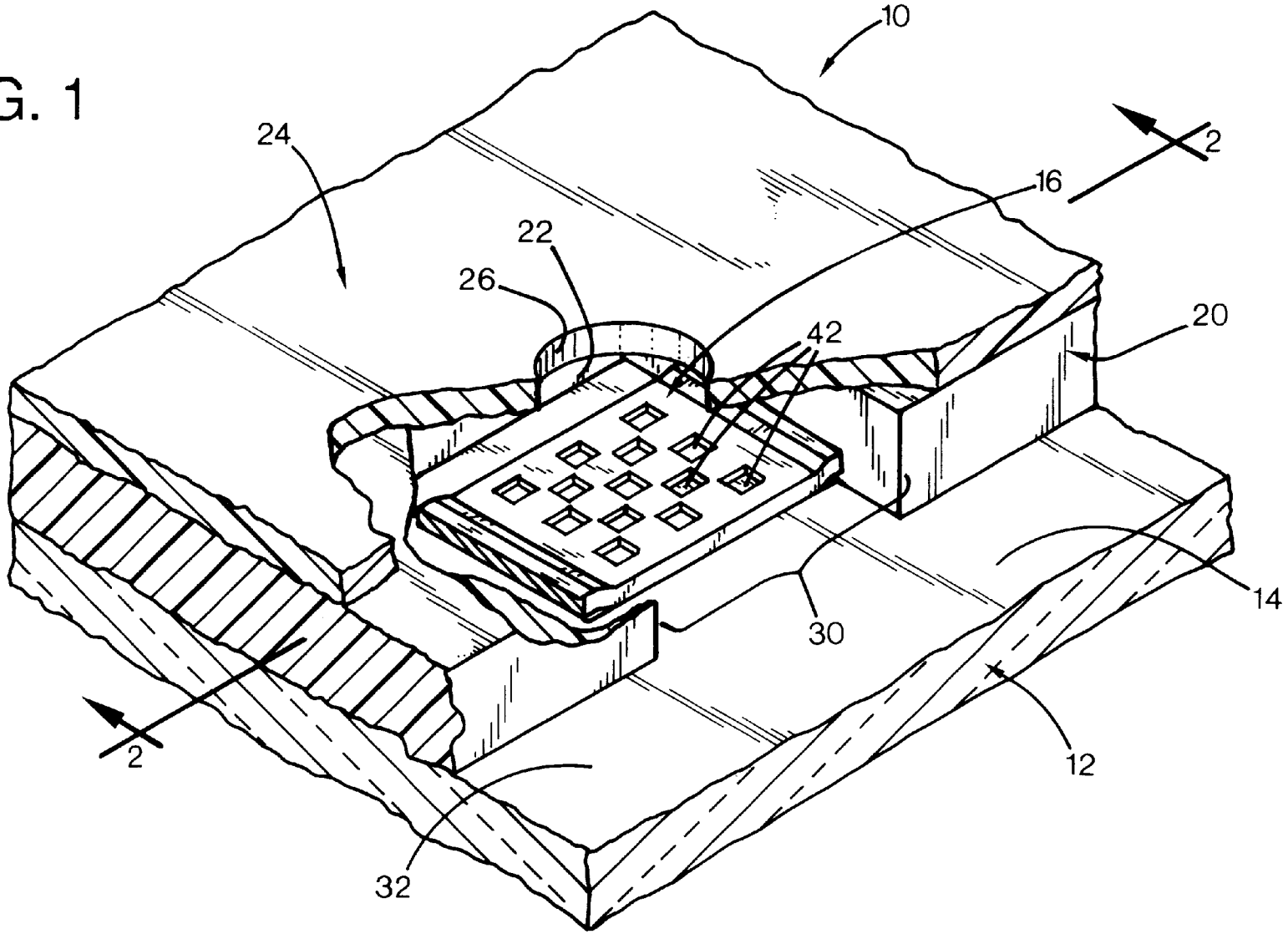
FIG. 1 is a sectional isometric view of a thermal ink jet printhead according to a preferred embodiment of the invention.

FIG. 1 illustrates a thermal ink jet printhead 10 having a rigid planar substrate 12 with a flat upper surface 14. A planar heater element 16 is applied to the upper surface of the substrate. A barrier layer 20 is applied to the substrate surrounding the heater element 16 to define a firing chamber 22 centered above the heater element. An orifice plate 24 is connected to the upper surface of the barrier layer to enclose the firing chamber, and defines an orifice 26 centered above the heater element. The firing chamber has at least one lateral opening 30 on at least one side to provide an inlet for ink supplied by an ink supply plenum 32. The printhead includes an elongated array of adjacent firing units having the same arrangement of heater element, chamber, and orifice, and supplied by the common plenum.

Figure 2:
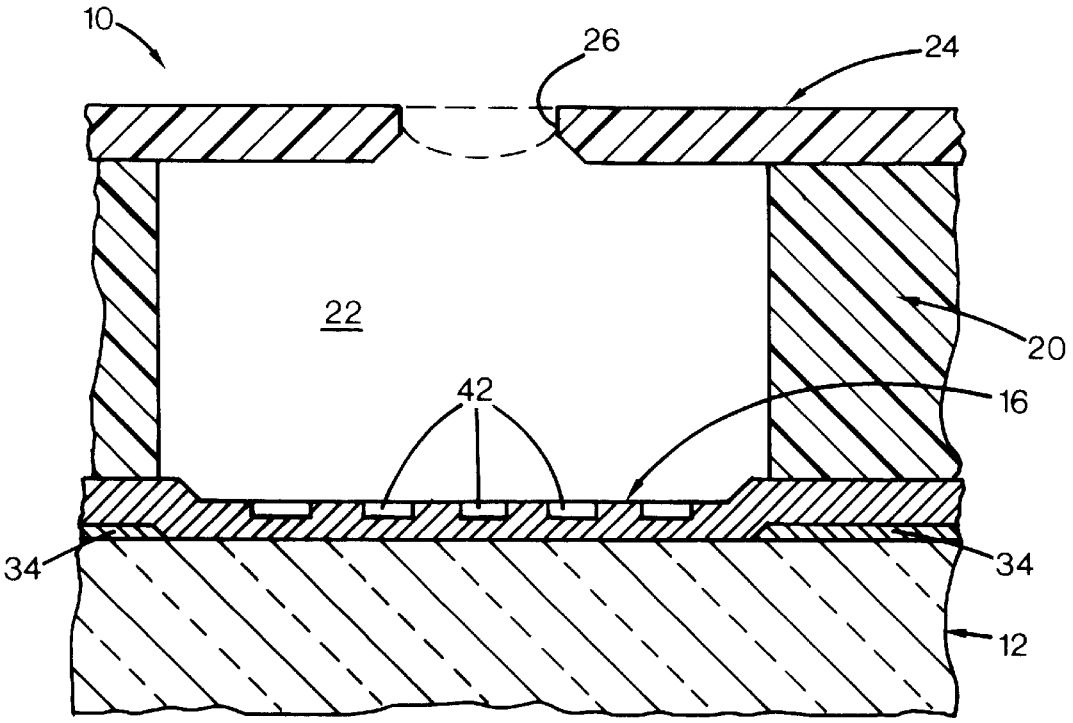
FIG. 2 is a sectional side view of the embodiment of FIG. 1 taken along line 2—2.

As shown in FIG. 2, the heater element 16 is connected between a pair of conductive aluminum leads 34 that overlay the upper surface 14 of the substrate 12, and which are connected to a powered controller (not shown) that applies a voltage across the heater element when a droplet of ink is required to be expelled from the firing unit.

Figure 3:
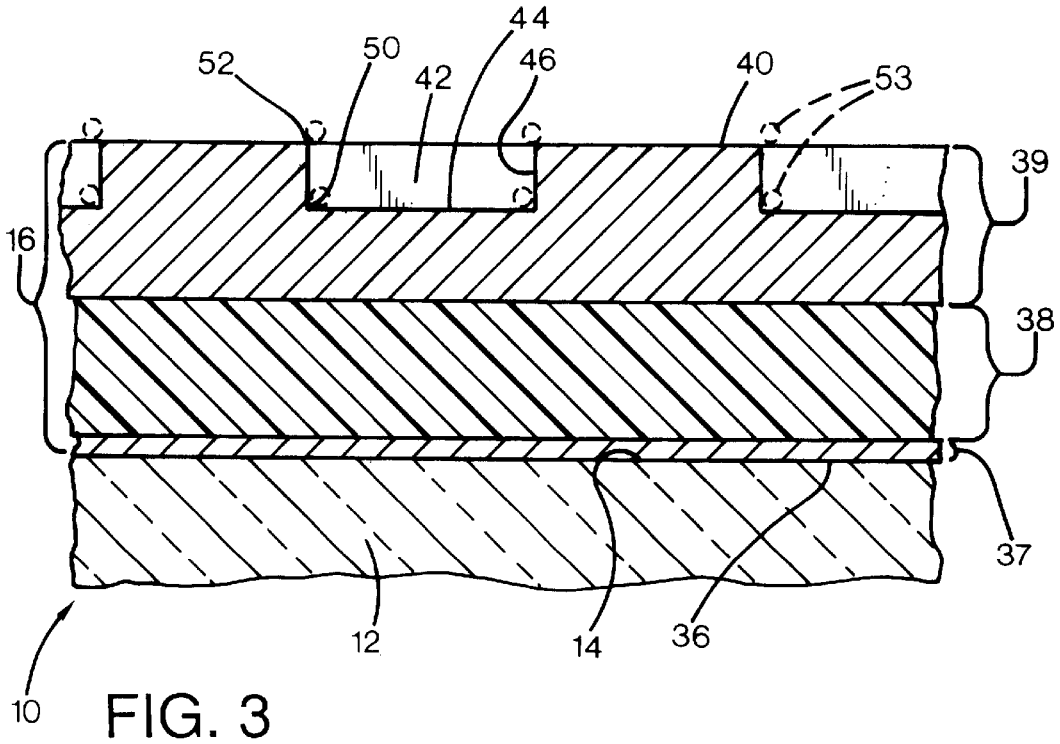
FIG. 3 is an enlarged sectional side view of the embodiment of FIG. 1 taken along line 2—2.

As shown in FIG. 3, the heater element 16 has a flat lower surface 36 and a parallel flat upper surface 14. The heater element is a stack of three layers. The lowest layer is a TaAl resistor film 37 resting on the substrate's upper surface 40. An electrically insulative passivation layer 38 overlays the resistor, and a mechanically protective tantalum cavitation barrier 39 overlays the passivation layer. The cavitation barrier 39 protects the resistor from the stresses of bubble formation and collapse during printing.

A plurality of separate square recesses 42 are defined in an array that extends across most of the surface of the heater element 16. The recesses have flat bottoms or floors 44 parallel to the upper and lower surfaces of the heater element, and extend to a limited depth so that the passivation layer 38 is not exposed within the recesses; in alternative embodiments, the passivation layer may be exposed. The periphery of each recess is defined by a vertical side wall 46 that provides a step between the level of the recess floors 44 and the upper surface 40 of the heater element. The side wall 46 meets the recess floor 44 at a sharp comer or interior edge 50, and meets the upper surface 40 at a rim edge 52. Both edges are sharp right angles, although variations will be discussed below. In practice, the sharp edges are slightly radiused due to inherent limitations of the etching process. These sharp edges provide nucleation sites 53 where boiling will tend to occur most rapidly, and at the lowest energy. In addition, the reduced thickness at the floor of a recess may provide a higher heat due to its proximity to the resistor and the reduced thermal gradient across the cavitation barrier 39 to further expedite boiling at the lower nucleation sites 50.

In the preferred embodiment the recesses 42 are arranged on a grid, with individual recesses positioned at alternate locations in the manner of a checkerboard. The recesses each have a width and length less than or equal to the pitch of the grid on which they are arranged, such that they are spaced apart at their comers to avoid intersecting with the comers of adjacent recesses. The etching process used to form the recesses after application of the heater element to the substrate yields recesses with rounded corners as viewed from above, providing separation even between recesses arranged on a grid having the same pitch as the width of the recesses. In the preferred embodiment, the recesses have a width of between 5 and 10 $\mu$m, although the advantages of the invention will be realized as further miniaturization becomes practical. In the illustrated embodiment, 13 recesses are provided, although more or fewer may be provided in other arrangements.

Figure 4:
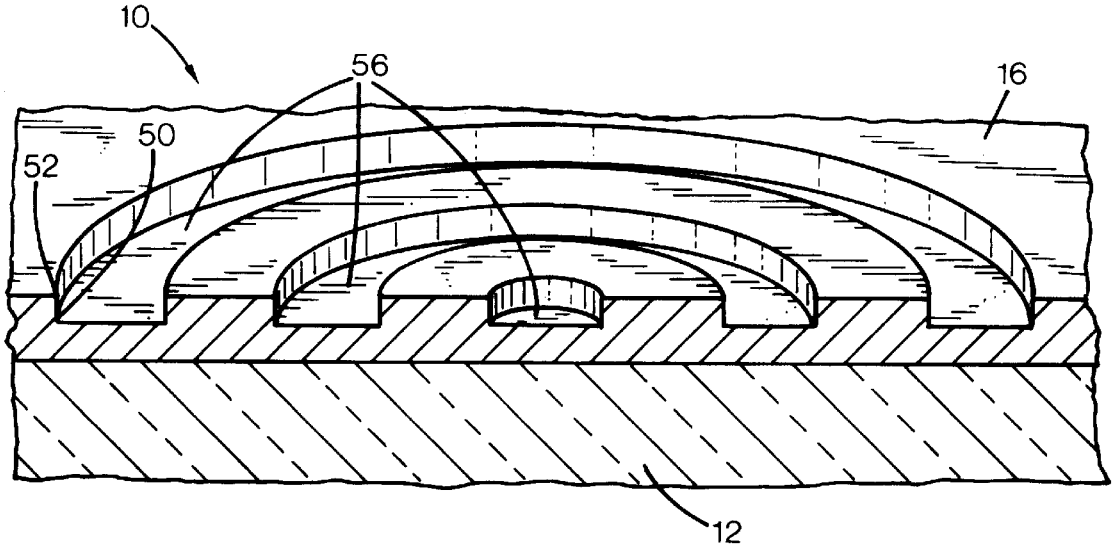
FIG. 4 is a sectional view of a first alternative embodiment of the invention.

FIGS. 4–8 illustrate alternative heater element surface contour patterns. FIG. 4 shows an alternative printhead with a heater element having a pattern of concentric ring-shaped recesses 56, each having a cross section similar to the recesses 42 of the preferred embodiment. The outer rings are large, and each ring functions as many recesses to provide many nucleation sites by having a substantial length of edges 50, 52 for a given major area of the heater element. It is also possible modify the illustrated pattern to form a spiral shape having similar recess and land widths over the same area. Although not literally a plurality of recesses, such a recess is considered a "plurality" for the purposes of this application because of the high ratio of edges 50, 52 to the overall area and linear dimensions of the heater element and of the recessed area. For the purpose of this application, a single "recess" or recess segment shall be defined as a basin, pocket, channel, groove, or segment thereof having edges surrounding more then half its periphery. Thus, an elongated channel may be considered as segmented into multiple individual recesses, each having a length only slightly longer than its width.

Figure 5:
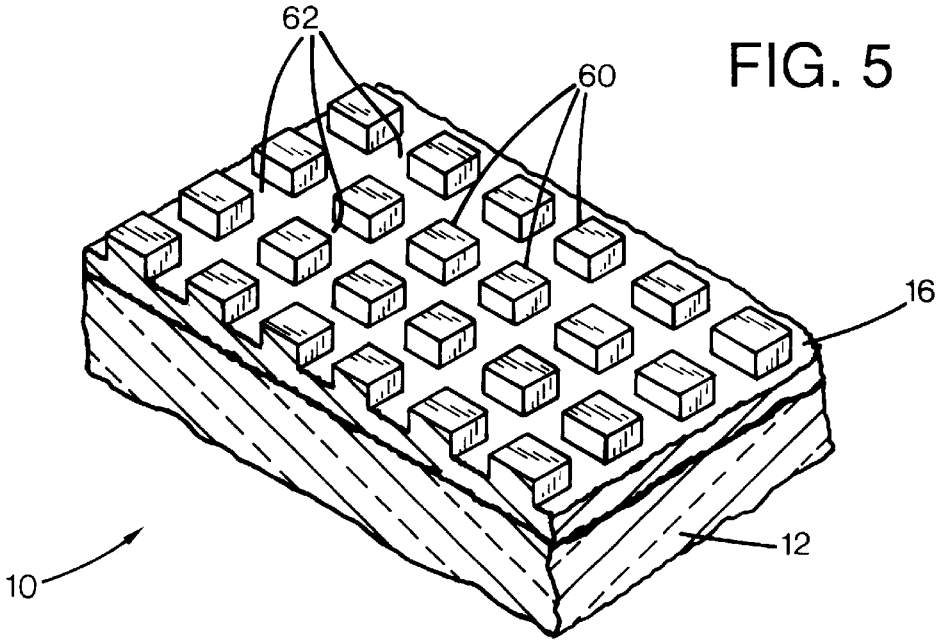
FIG. 5 is a sectional view of a second alternative embodiment of the invention.

As shown in FIG. 5, an alternative embodiment heater element has a rectangular array of separate square plateaus 60 defined by a grid of parallel channels 62. As noted above with respect to FIG. 4, the grid of channels is considered to be a plurality of recesses, because the edges of the plateaus have a cumulative length much greater than the cumulative length of the edges of a single regular recess such as a square, circle, oblong, or similar simple shape of the same area.

Figure 6:
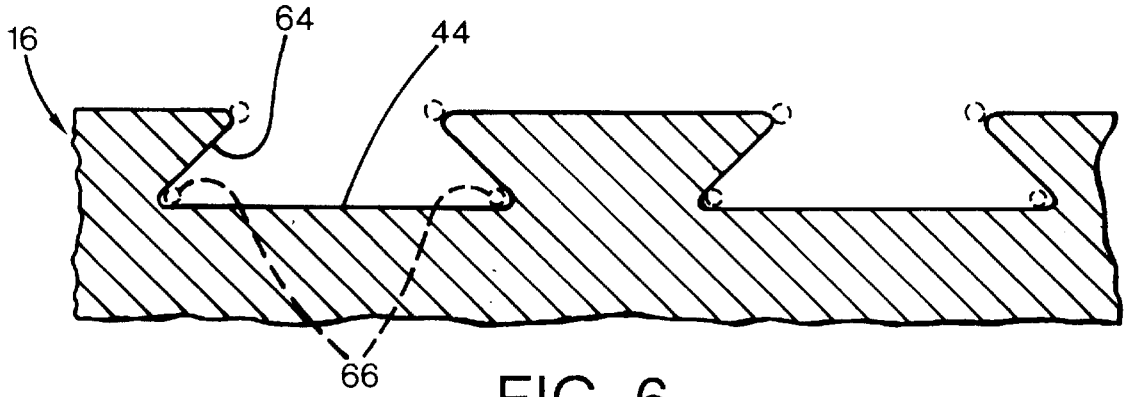
FIG. 6 is a sectional view of a third alternative embodiment of the invention.
Figure 7:
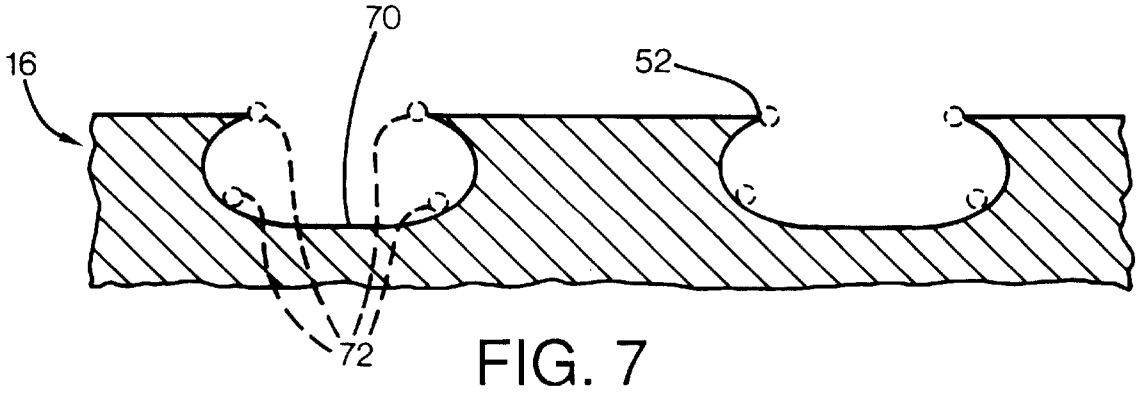
FIG. 7 is a sectional view of a fourth alternative embodiment of the invention.
Figure 8:
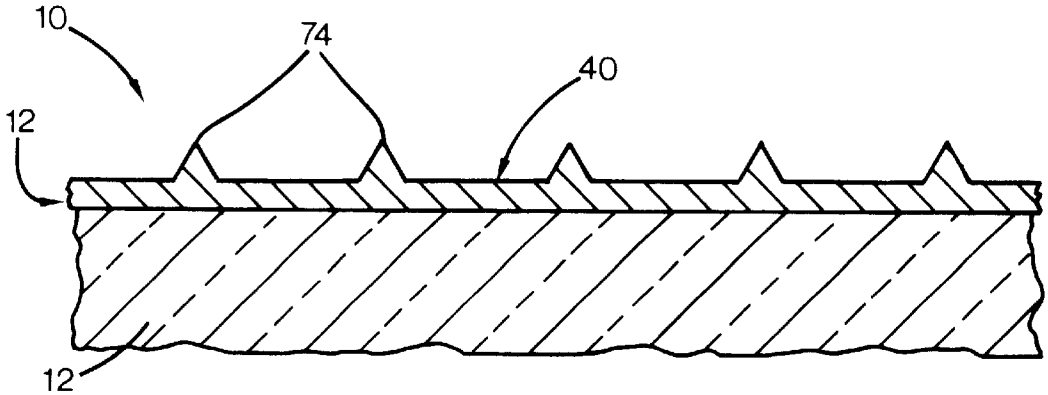
FIG. 8 is a sectional view of a fifth alternative embodiment of the invention.

While the preferred embodiment is discussed in terms of recesses having perpendicular side walls and a rectangular profile, FIGS. 6, 7, and 8 illustrate alternative channel profiles. In FIG. 6, the side walls 64 are undercut, such that they form an acute angle with respect to the flat floor 44. An acute lower nucleation site 66 is positioned at least partly below the side wall for enhanced nucleation. Side walls may be effectively offset from the perpendicular by any amount, including obtuse angles. FIG. 7 shows a variation on the undercut of FIG. 6 in which a conventional etching process yields a channel 70 with a curved or elliptical profile, at least at the edges. The nucleation sites 72 are located similarly to those in FIG. 6, although the illustrated etching technique may provide more acute upper edges 52 to further favor nucleation.

FIG. 8 illustrates a further alternative embodiment in which the heater element surface 40 is primarily a flat plane, with an array of protruding ridges 74 spaced apart across the surface. The ridges of the FIG. 8 embodiment and the recesses of the FIG. 5 and 6 embodiments may all be formed in any of the patterns discussed above and illustrated in FIGS. 1–5.

Operation of Prior Art

Figure 9A:
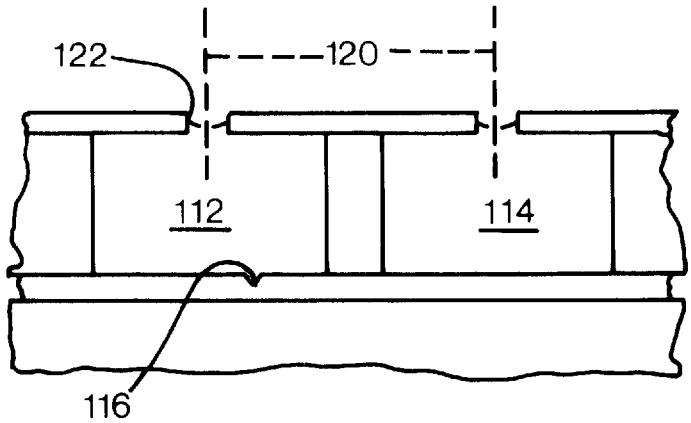
FIG. 9A Prior Art
FIGS. 9A–9D illustrate a sequence of operation of a prior art apparatus.
Figure 9B:
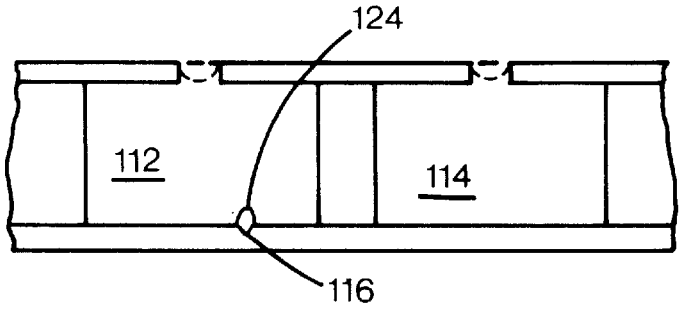
FIG. 9B Prior Art

FIGS. 9A–9D show the limitations of a prior art thermal ink jet printhead 110. It is constructed essentially the same as the preferred embodiment of the invention, except that it has a flat heater element surface instead of a contoured surface. The prior art printhead 110 has a pair of firing chambers 112, 114. In chamber 114, the heater element has an unintended defect crack 116 offset randomly from a central axis 120 passing through the orifice 122. The heater element in the right firing chamber 114 is free of defects. Consequently, as shown in FIG. 9B, simultaneous application of energy to both heater elements results initially in the nucleation of a bubble 124 at the defect 116 in the left chamber 112. Because higher energy is required without a nucleation site, the right chamber has not yet commenced bubble formation.

Figure 9C:
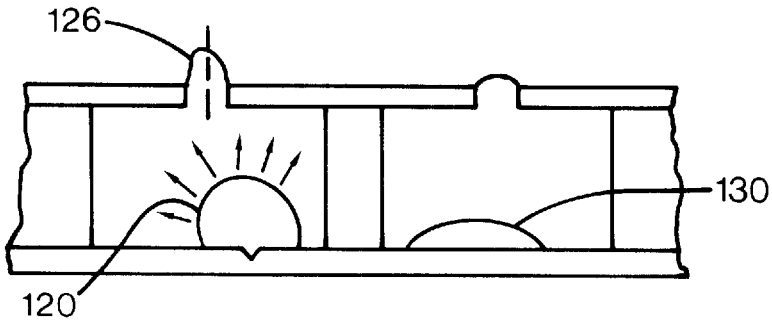
FIG. 9C Prior Art
Figure 9D:
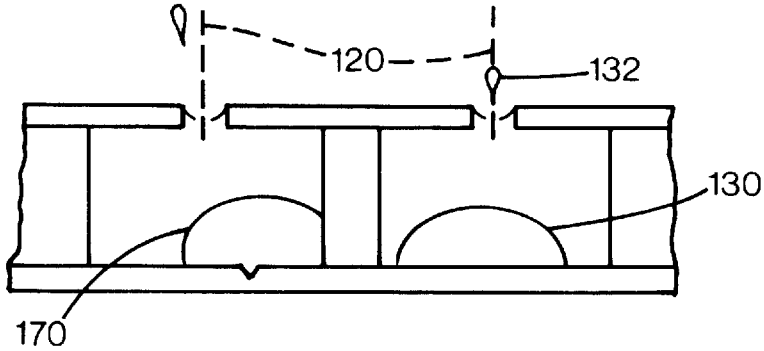
FIG. 9D Prior Art

As shown in FIG. 9C, the left bubble 124 has grown sufficiently to begin displacing a droplet 126 from the left orifice 122. Meanwhile, a bubble 130 has formed in the right chamber, but is smaller than the left bubble 120 because of its delayed formation due to the higher energy to begin bubble formation without the benefit of a nucleation site. In FIG. 9D, the left droplet has been ejected on a path that deviates from the axis because of the off-center location of the bubble. The left droplet 126 is spatially deviated from the location where it is intended to impact the print medium (not shown). A right droplet 132 happens to be ejected on axis, but is temporally deviated from its position. As the printhead rapidly traverses over the print medium, delayed droplets will be deposited farther down range along the printhead path than if they were timely expelled.

Operation of Preferred Embodiment

Figure 10A:
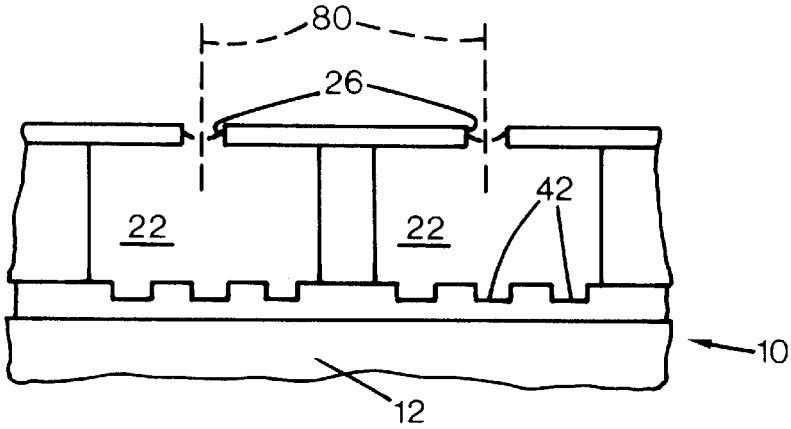
FIGS. 10A–10D illustrate a sequence of operation of the embodiment of FIG. 1.
Figure 10B:
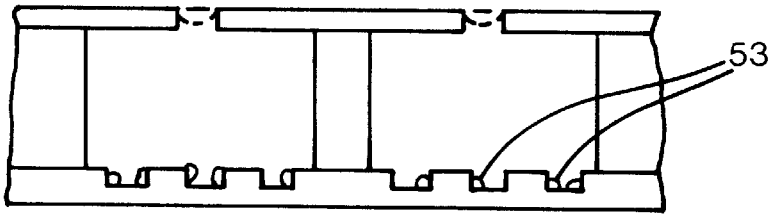

As shown in FIGS. 10A–10D, the preferred embodiment suffers from neither temporal nor spatial droplet deviation. In FIG. 10B, nucleation occurs at many or most of the recesses 42. Even if nucleation does not occur at every site, or in every recess, there are sufficient recesses and sites so that at least some nucleation sites will promptly begin bubble formation, avoiding temporal deviation. The number of sites also ensures that the resulting bubbles are well distributed, even if all sites are not effective for nucleation, avoiding spatial deviation. The quantity and wide distribution of recesses provides an accelerated transition from nucleate to film boiling, further improving uniformity.

Figure 10C:
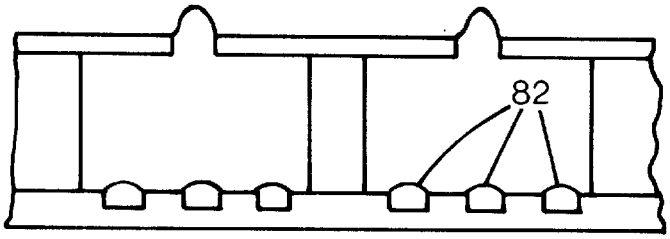
Figure 10D:
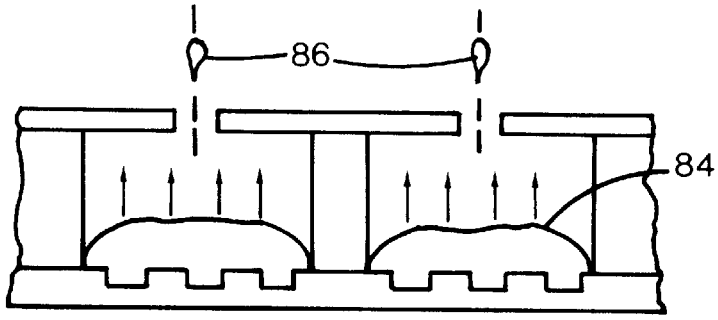

FIG. 10C shows small bubbles 82 forming in most or all recesses 42. In FIG. 10D the bubbles 82 have coalesced in each firing chamber. The resulting bubbles 84 have a flatter surface or "wave front" to eject droplets 86 reliably on axis.

By providing a flat wave front, the sensitivity of orifice position is reduced. This is an improvement over prior art systems in which positioning the orifice slightly off axis relative to a spherically expanding bubble can generate turbulence and lateral flow in the ink near the orifice.

In the preferred embodiment, the heater element 16 has an overall thickness of about 8–10 μm. Typically, the resistor 37 is 0.10 μm thick, the passivation 38 is 0.75 μm thick, and the cavitation barrier 39 is 0.6 μm thick. The aluminum leads 43 are about 0.7 Mm thick, and are positioned between the resistor layer and the passivation layer. In a typical application, adjacent firing units are spaced apart 40–80 μm on center, each orifice having a diameter of 10–50 μm, and spaced above the heater element surface by 14–25 μm. The heater element is a square about 20–60 μm on a side, and the firing chamber has a width or diameter of about 16 μm greater than the resistor. Although the recess are formed by etching after the sequential photoimaging of the resistor and other layers, and before the addition of the barrier and orifice plate, the cavitation barrier may be imaged in two steps: first, imaging a continuous flate layer, and second, imaging a perforated layer to define the recesses.

While the disclosure is described in terms of preferred and alternative embodiments, the invention is not intended to be so limited.

What is claimed is:

1. A thermal ink jet printhead comprising:

a body defining an ink firing chamber;

the body defining an orifice providing fluid communication from the firing chamber to a location outside of the printhead and occupying a first plane, the orifice defining an ejection direction axis perpendicular to the first plane;

an electrically activated heating element connected to the body, and in thermal communication with the firing chamber;

the firing chamber including a contoured surface portion coextensive with at least a portion of the heating element;

at least a major portion of the contoured surface portion occupying a second plane parallel to the first plane, and perpendicular to the ejection direction;

the orifice being registered with the contoured surface portion; and the contoured surface portion of the firing chamber defining a plurality of recsses and a plurality of elevated portions, the recesses and elevated portions occupying parallel, spaced apart planes.

2. The thermal ink jet printhead of claim 1 wherein the recesses are arranged in an array that is distributed over at least a major portion of the heating element.

3. The thermal ink jet printhead of claim 1 wherein the heating element has a lower surface conforming to a planar substrate portion of the body, and a parallel upper surface, and wherein the recesses have flat bottoms parallel to the substrate.

4. The thermal ink jet printhead of claim 1 wherein at least some of the recesses are elongated channels.

5. The thermal ink jet printhead of claim 1 wherein at least some of the recesses are interconnected such that they surround and define a plurality of flat surface plateaus elevated above the recesses.

6. The thermal ink jet printhead of claim 1 wherein the heating element comprises a contoured thermally conductive portion overlaying a flat resistor.

7. The thermal ink jet printhead of claim 1 at least some of the recesses are channel segments abutting end-to-end to form a single channel.

8. The thermal ink jet printhead of claim 1 wherein the recesses have flat bottoms occupying a first plane at a first level, and including a plurality of elevated portions at a second level above the first level.

9. A method of manufacturing a thermal in jet printhead comprising the steps:

providing a substrate;

applying a heating element to substrate;

forming a contoured surface of the heating element, the contoured surface having a plurality of first surface portions at a first level, a plurality of second surface portions at a different second level, and defining a plurality of recesses extending parallel to a major plane of the heating element; and connecting to the substrate a plate defining an orifice having an ejection-direction axis perpendicular to the plate, including orienting the plate with the ejection-direction axis perpendicular to the major plane and spaced apart from the heating element to define a chamber, including aligning the ejection-direction axis to intersect the contoured surface.

10. The method of claim 9 wherein the step of forming the contoured surface comprises removing material from the heating element.

11. The method of claim 9 wherein the step of forming the contoured surface comprises etching the heating element.

12. The method of claim 9 wherein the step of forming the contoured surface comprises defining a plurality of edges, each defining a boundary between a first surface portion and a second surface portion.

13. The method of 12 wherein the step of defining a plurality of edges includes undercutting the first surface portions such that grooves are defined below the edges.

14. A thermal ink jet printhead comprising:

a body defining a plurality of ink firing chambers;

for each firing chamber, the body defining an orifice centered on and perpendicular to an ejection-direction axis, the orifice providing fluid communication from the firing chamber to a location outside of the printhead;

a plurality of electrically activated heating elements, each connected to the body in thermal communication with each firing chamber, and each heating element having a contoured surface defining a contoured surface portion of the firing chamber registered with a respective orifice; and each contoured surface portion of the firing chamber defining a plurality of contour features angularly offset from the ejection-direction axis.

15. The thermal ink jet printhead of claim 14 wherein the contoured surface portion includes a plurality of edges, each edge defining a boundary between a first surface portion and an adjacent second surface portion and each edge having at least one edge wall portion that is offset at an angle from adjacent first and second surface portions, and wherein each second surface portion abuts a respective first surface portion at a respective edge wall.

16. The thermal ink jet printhead of claim 15 wherein the edge wall portion is offset from at least one of the adjacent surface portions by at least 90 degrees, such that the edge wall portion is perpendicular to or acute to the at least one of the adjacent surface portions.

17. The thermal ink jet printhead of claim 15 wherein each first surface portion occupies a first plane, and each second surface portion is a recessed basin occupying a second plane below the first plane.

18. The thermal ink jet printhead of claim 17, wherein the second surface portions are evenly spaced apart to form a regular array.

19. The thermal ink jet printhead of claim 14 wherein each of the heating elements has substantially the same contoured surface pattern such that uniform heater performance is provided.

20. The thermal ink jet printhead of claim 14 wherein the contoured surface portion is larger than the width of the orifice.

* * * * *